US009962934B2

(12) United States Patent
Watanabe et al.

(10) Patent No.: US 9,962,934 B2
(45) Date of Patent: May 8, 2018

(54) LIQUID EJECTING HEAD, LIQUID EJECTING HEAD UNIT, LIQUID EJECTING APPARATUS, AND METHOD FOR MANUFACTURING LIQUID EJECTING HEAD UNIT

(71) Applicant: SEIKO EPSON CORPORATION, Tokyo (JP)

(72) Inventors: Shunsuke Watanabe, Matsumoto (JP); Shingo Tomimatsu, Matsumoto (JP); Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/460,351

(22) Filed: Mar. 16, 2017

(65) Prior Publication Data

US 2017/0274655 A1 Sep. 28, 2017

(30) Foreign Application Priority Data

Mar. 28, 2016 (JP) ..... 2016-063253

(51) Int. Cl.

| | |
|---|---|
| ***B41J 2/14*** | (2006.01) |
| ***B41J 2/045*** | (2006.01) |
| ***B41J 2/16*** | (2006.01) |

(52) U.S. Cl.

CPC ..... *B41J 2/14233* (2013.01); *B41J 2/04581* (2013.01); *B41J 2/1433* (2013.01); *B41J 2/161* (2013.01); *B41J 2/162* (2013.01); *B41J 2/1623* (2013.01); *B41J 2202/19* (2013.01); *B41J 2202/22* (2013.01)

(58) Field of Classification Search

None

See application file for complete search history.

(56) References Cited

U.S. PATENT DOCUMENTS

2004/0056937 A1 3/2004 Ito
2013/0147882 A1* 6/2013 Okui ..... B41J 2/1433 347/71

FOREIGN PATENT DOCUMENTS

JP 2004-106395 A 4/2004
JP 2009-126012 A 6/2009

* cited by examiner

*Primary Examiner* — Lisa M Solomon
(74) *Attorney, Agent, or Firm* — Workman Nydegger

(57) ABSTRACT

A liquid ejecting head includes a plurality of actuators, a plurality of pressure chambers that are provided so as to correspond to the actuators, and communicate with a common liquid chamber, a first member that defines the common liquid chamber, and includes a compliance sheet that absorbs vibrations of liquid on an upstream side of the common liquid chamber, and an inlet that is formed so as to penetrate the compliance sheet, a canopy portion that is provided at an open peripheral edge of the inlet of the first member, and has a receiving surface to which the compliance sheet is joined, and a receiving portion that is provided opposite the inlet across the canopy portion, and receives liquid introduced from the inlet.

15 Claims, 13 Drawing Sheets

LIQUID EJECTING HEAD, LIQUID EJECTING HEAD UNIT, LIQUID EJECTING APPARATUS, AND METHOD FOR MANUFACTURING LIQUID EJECTING HEAD UNIT

CROSS-REFERENCE TO RELATED APPLICATIONS

The entire disclosure of Japanese Patent Application No.: 2016-063253, filed Mar. 28, 2016 is incorporated by reference herein.

BACKGROUND

1. Technical Field

The present invention relates to a liquid ejecting head that ejects liquid, a liquid ejecting head unit including the liquid ejecting head, a liquid ejecting apparatus, and a method for manufacturing the liquid ejecting head unit, and more particularly, to an ink jet recording head that ejects ink as liquid, an ink jet recording head unit, an ink jet recording apparatus, and a method for manufacturing the ink jet recording head unit.

2. Related Art

As a liquid ejecting head, for example, there is known an ink jet recording head that ejects ink droplets from nozzles by using a pressure change of a pressure generating unit. As the ink jet recording head, there is proposed an ink jet recording head in which a part of walls of a flow channel communicating with a nozzle that ejects ink droplets is formed of a flexible plate (compliance sheet) deformable in response to a pressure change of ink (see, for example, JP-A-2004-106395).

The ink jet recording head of JP-A-2004-106395 is formed by the following method. That is, flow channels are formed by laminating metal plates having recesses or openings formed therein by laser processing or etching. Then, a resin or metal flexible plate (compliance sheet) is bonded to the laminated plates.

In order to bond a flow channel member having upstream flow channels to the inlets of the adherent member to which the compliance sheet is bonded, however, the adherent member needs to have rigidity around the inlets. A low rigidity may cause problems of peeling and ink leakage due to joining failure.

The compliance sheet may be bonded to the adherent member by using an adhesive body obtained by laminating the compliance sheet on a metal rigid member, but the use of the rigid member may cause a problem of an increase in the material cost. Even when the rigid member is directly used as a member that constitutes the flow channels as in JP-A-2004-106395, an unnecessary portion needs to be removed from the rigid member by etching, laser processing, or the like after the compliance sheet has been laminated on the rigid member. This process may cause a problem of an increase in the manufacturing cost.

SUMMARY

An advantage of some aspects of the invention is that a liquid ejecting head, a liquid ejecting head unit, a liquid ejecting apparatus, and a method for manufacturing the liquid ejecting head unit, in which a compliance sheet can be bonded at a low cost while suppressing joining failure thereof, are provided.

According to an aspect of the invention, there is provided a liquid ejecting head including a plurality of actuators, a plurality of pressure chambers that are provided so as to correspond to the actuators, and communicate with a common liquid chamber, a first member that defines the common liquid chamber, and includes a compliance sheet that absorbs vibrations of liquid on an upstream side of the common liquid chamber, and an inlet that is formed so as to penetrate the compliance sheet, a canopy portion that is provided at an open peripheral edge of the inlet of the first member, and has a receiving surface to which the compliance sheet is joined, and a receiving portion that is provided opposite the inlet across the canopy portion, and receives liquid introduced from the inlet.

According to this aspect, the compliance sheet can be supported by the canopy portion, and hence a member having an upstream flow channel can easily be joined around the inlet of the compliance sheet. Further, there is no need to use a rigid member that is integrated with the compliance sheet so as to secure the rigidity of the inlet of the compliance sheet.

It is preferred that the first member and the compliance sheet be bonded to each other with an adhesive. According to this configuration, the first member and the compliance sheet can securely be joined to each other with the adhesive.

According to another aspect of the invention, there is provided a liquid ejecting head unit including a plurality of the liquid ejecting heads according to the aspect described above, and a holder to which the compliance sheets of the plurality of the liquid ejecting heads are fixed in common.

According to this aspect, the plurality of the liquid ejecting heads provided with the compliance sheets can be fixed to the common holder.

It is preferred that the holder and the first member be non-metallic members. According to this configuration, an interface between a metal and an adhesive is reduced in the first member, the film, and the holder, and hence the bonding strength can be improved. Further, the cost can be reduced by using a material other than a metal for the first member and the holder.

Further, it is preferred that the first member and the holder be formed of the same material. According to this configuration, the difference in the coefficient of linear expansion between the first member and the holder is reduced, and hence warpage and peeling of the first member and the holder due to the difference in the coefficient of linear expansion can be suppressed and creasing and peeling of the film can be suppressed as well.

According to a further aspect of the invention, there is provided a liquid ejecting apparatus including the liquid ejecting head unit according to the aspect described above.

According to this aspect, a liquid ejecting apparatus in which the peeling of the compliance sheet and the leakage of liquid are suppressed can be achieved.

According to a still further aspect of the invention, there is provided a method for manufacturing a liquid ejecting head unit. The liquid ejecting head unit includes a plurality of liquid ejecting heads and a holder to which the plurality of liquid ejecting heads are joined in common. Each of the liquid ejecting heads includes a plurality of actuators, a plurality of pressure chambers that are provided so as to correspond to the actuators, a common liquid chamber that communicates with the plurality of pressure chambers in common, a first member that defines the common liquid chamber, and includes a compliance sheet that absorbs vibrations of liquid on an upstream side of the common liquid chamber, and an inlet that is formed so as to penetrate the compliance sheet, a canopy portion that is provided at an open peripheral edge of the inlet of the first member, and has a receiving surface to which the compliance sheet is joined, and a receiving portion that is provided opposite the inlet across the canopy portion, and receives liquid introduced from the inlet. The method includes forming the liquid ejecting heads by joining the compliance sheets at least to the receiving surfaces of the canopy portions, respectively, and joining the compliance sheets of the plurality of liquid ejecting heads to the holder with an adhesive.

According to this aspect, the compliance sheet is joined to the first member, and hence the opening of the common liquid chamber is sealed with the compliance sheet. Thus, the entry of a foreign substance into the common liquid chamber can be suppressed. Further, the plurality of liquid ejecting heads are bonded to the holder after the compliance sheets have been joined to the first members, respectively, and hence the heights of the liquid ejecting surfaces of the plurality of liquid ejecting heads can be set equal to each other. Moreover, the dimensional variation can be absorbed by the adhesive that bonds the holder and the liquid ejecting heads to each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention is described below in detail on the basis of embodiments.

First Embodiment

Figure 1:
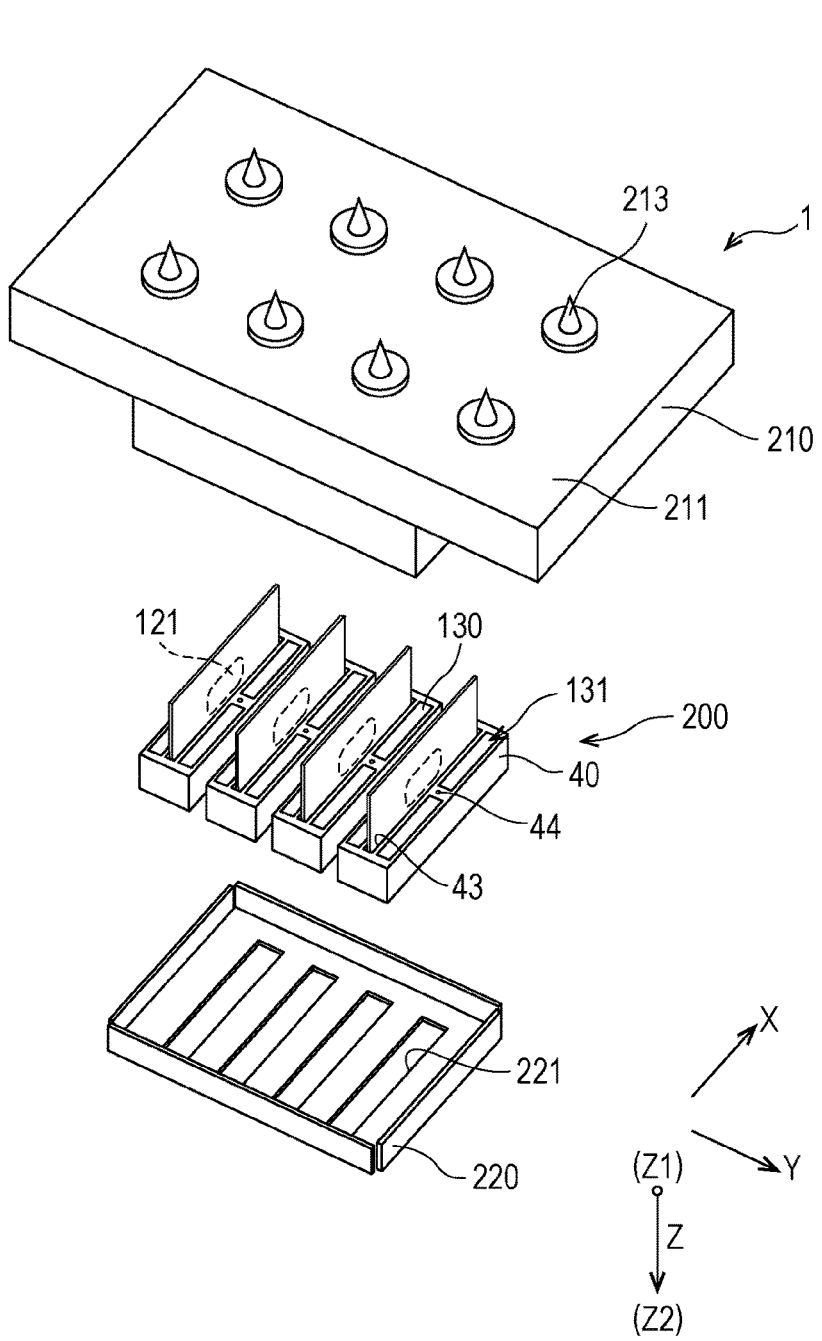
FIG. 1 is an exploded perspective view of a head unit according to a first embodiment.
Figure 2:
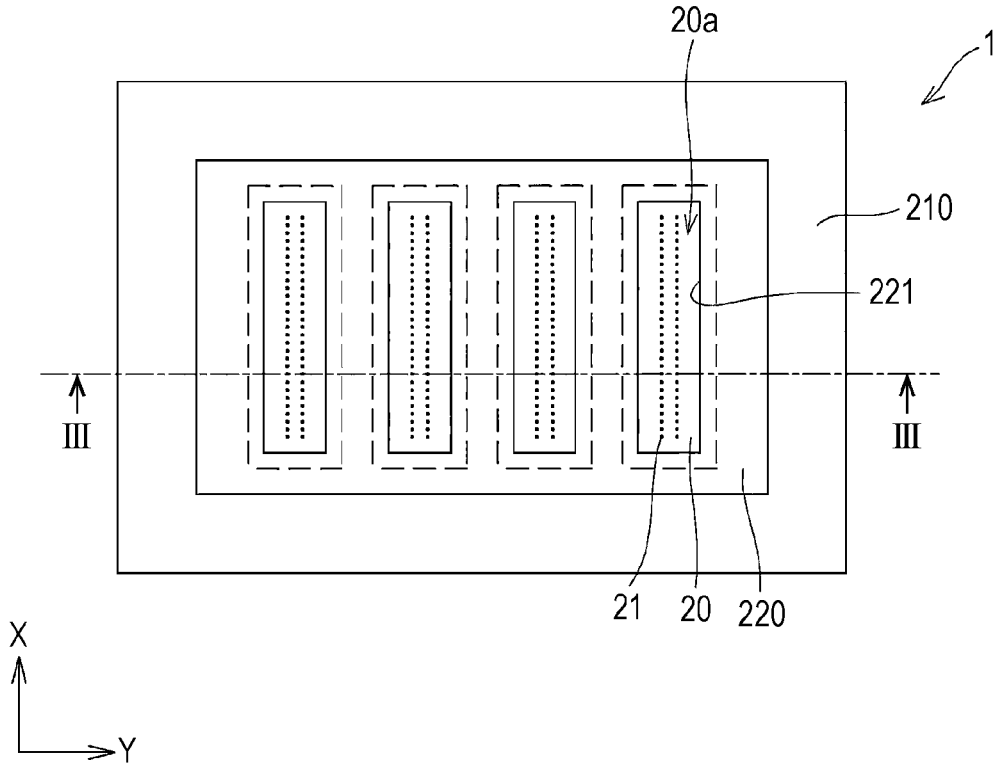
FIG. 2 is a plan view of the head unit according to the first embodiment.
Figure 3:
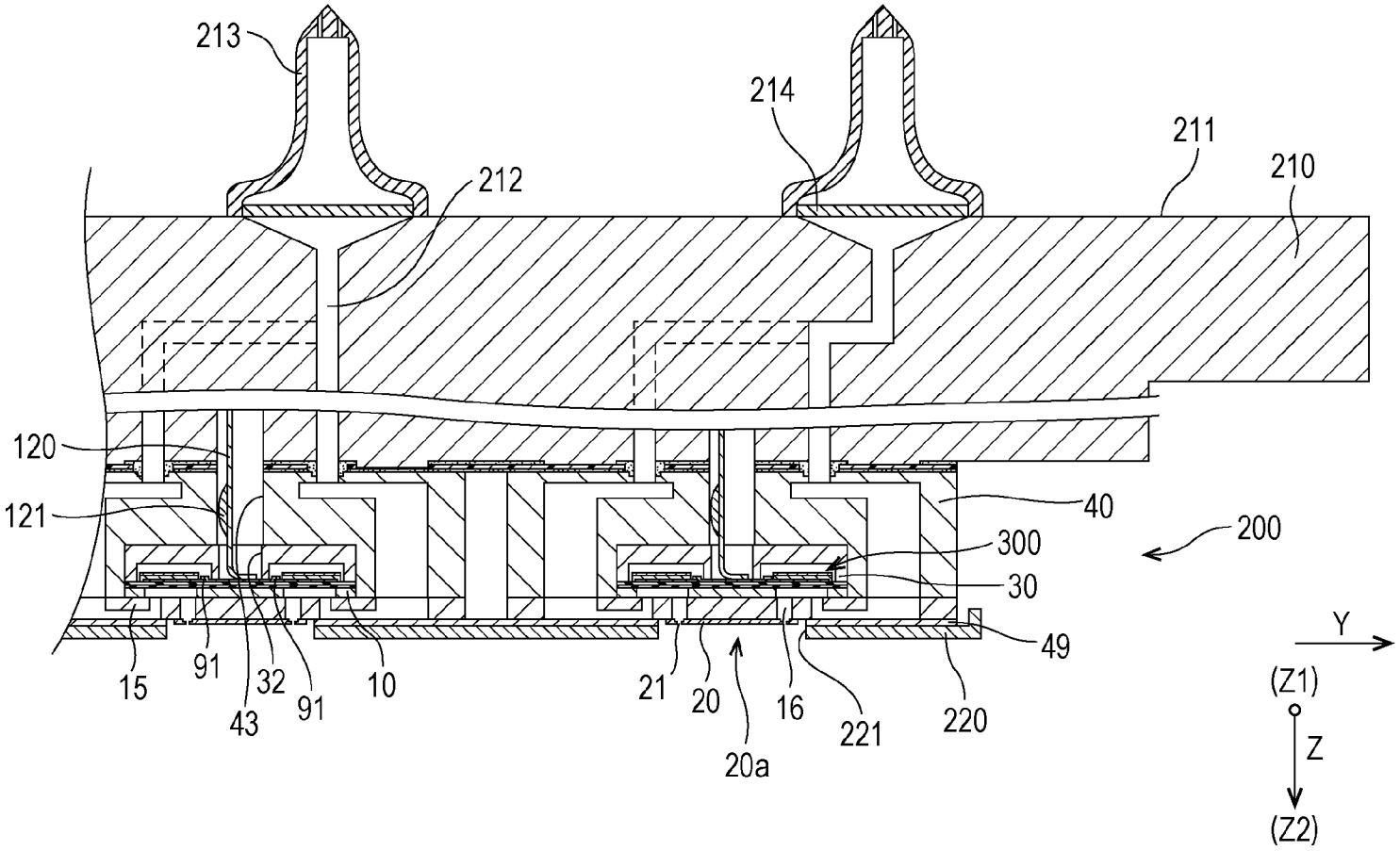
FIG. 3 is a sectional view of the head unit according to the first embodiment.

FIG. 1 is an exploded perspective view of an ink jet recording head unit that is an example of a liquid ejecting head unit according to a first embodiment of the invention. FIG. 2 is a plan view of the ink jet recording head unit. FIG. 3 is a sectional view taken along the line III-III of FIG. 2.

As illustrated in FIG. 1 to FIG. 3, an ink jet recording head unit 1 (hereinafter also referred to simply as a head unit 1) includes a plurality of ink jet recording heads 200 (hereinafter also referred to simply as recording heads 200) that eject ink as ink droplets, a holder 210 that holds the plurality of recording heads 200 in common, and a cover head 220 that covers liquid ejecting surface 20*a* sides of the plurality of recording heads 200.

Nozzles 21 that eject ink as ink droplets are juxtaposed in each of the recording heads 200. In this embodiment, the direction in which the nozzles 21 are juxtaposed is referred to as a first direction X. Further, a plurality of arrays, in this embodiment two arrays of the nozzles 21 juxtaposed in the first direction X, are provided in each of the recording heads 200. The direction in which the arrays of the nozzles 21 are provided is hereinafter referred to as a second direction Y. In addition, the direction intersecting both of the first direction X and the second direction Y is referred to as a third direction Z in this embodiment. In the third direction Z, the holder 210 side is referred to as a Z1 side, and the recording head 200 side is referred to as a Z2 side. In this embodiment, the respective directions (X, Y, Z) are orthogonal to each other, but the relationship of arrangement of the respective components is not necessarily limited to the orthogonal relationship.

A plurality of the recording heads 200, in this embodiment four recording heads 200, are juxtaposed in the second direction Y and held by the holder 210.

The holder 210 includes, on the Z1 side, a connection section 211 to which liquid storing units such as ink tanks or ink cartridges that store ink as liquid are connected directly or via supply tubes. Further, the holder 210 is provided with a plurality of ink communication paths 212 each having one end that is open at the connection section 211 on the Z1 side and the other end that is open on the Z2 side. At the openings of the ink communication paths 212 of the connection section 211, supply portions 213 to be connected to the liquid storing units are fixed to the connection section 211 with filters 214 for air bubbles, dust, or the like in the ink interposed therebetween. In this embodiment, the supply portion 213 protrudes toward the Z1 side in the form of a needle.

The plurality of recording heads 200, in this embodiment four recording heads 200, are juxtaposed in the second direction Y and fixed to the surface of the holder 210 on the Z2 side. The ink supplied from the supply portions 213 is supplied to the recording heads 200 via the ink communication paths 212.

Further, the cover head 220 is provided on the Z2 side of the recording heads 200 where the nozzles 21 are open. For each of the recording heads 200, the cover head 220 has an exposure opening 221 through which the nozzles 21 are exposed. That is, four exposure openings 221 are provided in the cover head 220. The liquid ejecting surface 20*a* sides of the recording heads 200 are fixed around the exposure openings 221 of the cover head 220. That is, the surfaces of the plurality of recording heads 200 on the Z2 side that is the liquid ejecting surface 20*a* side are fixed to the common cover head 220. As a method for fixing the cover head 220 and the recording heads 200, bonding with an adhesive or welding is given, for example.

Figure 4:
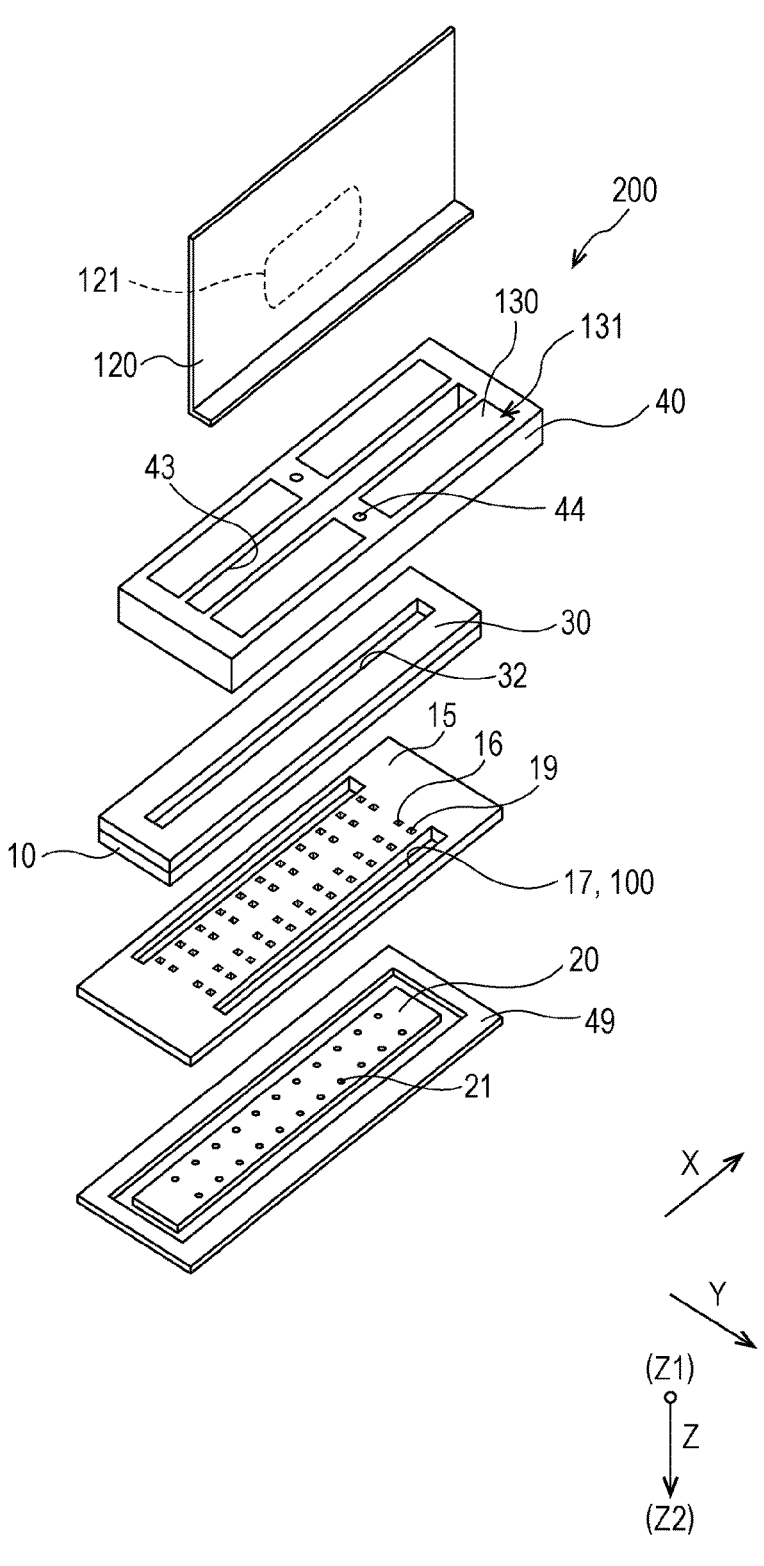
FIG. 4 is an exploded perspective view of a recording head according to the first embodiment.
Figure 5:
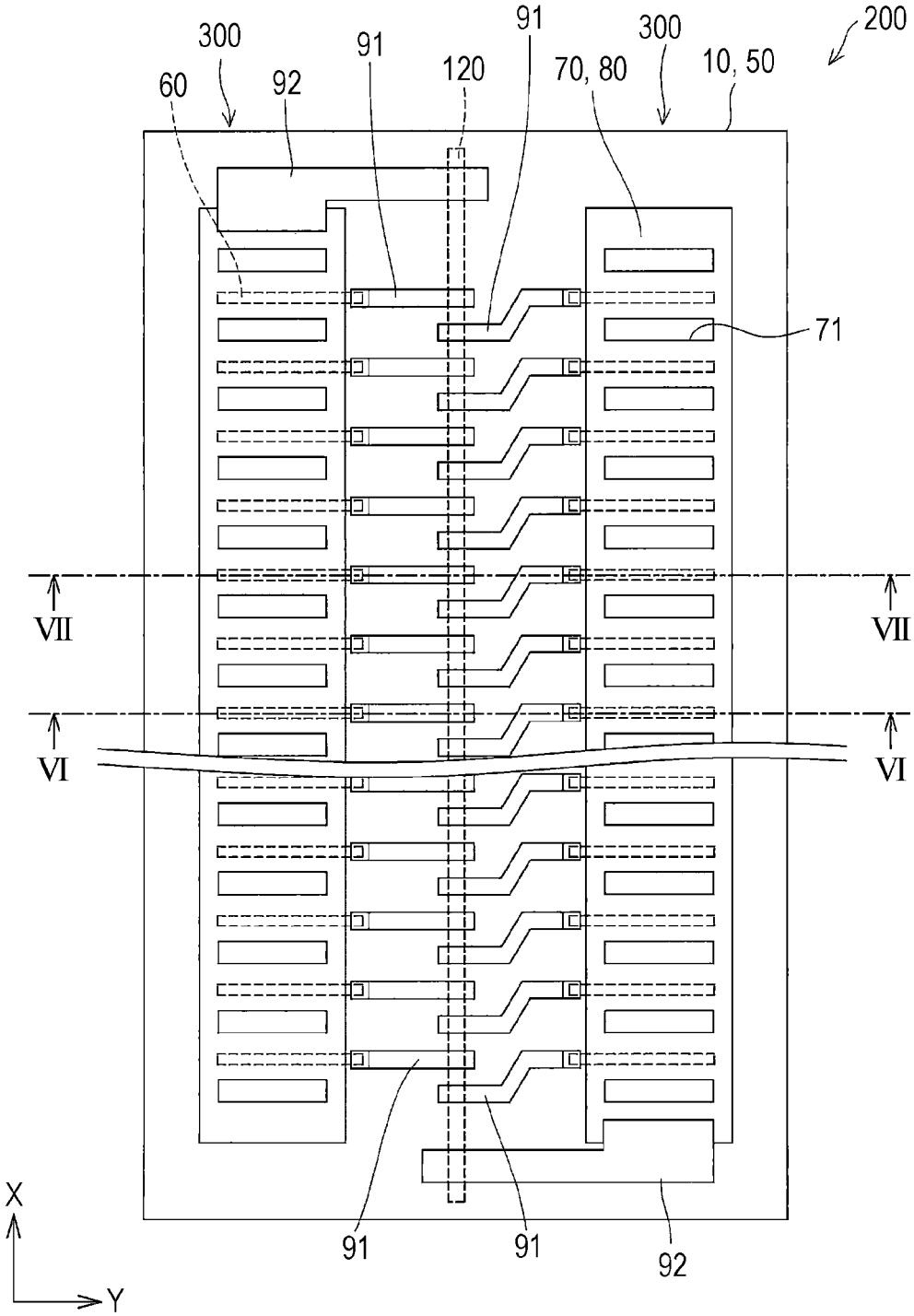
FIG. 5 is a main-part plan view of the recording head according to the first embodiment.
Figure 6:
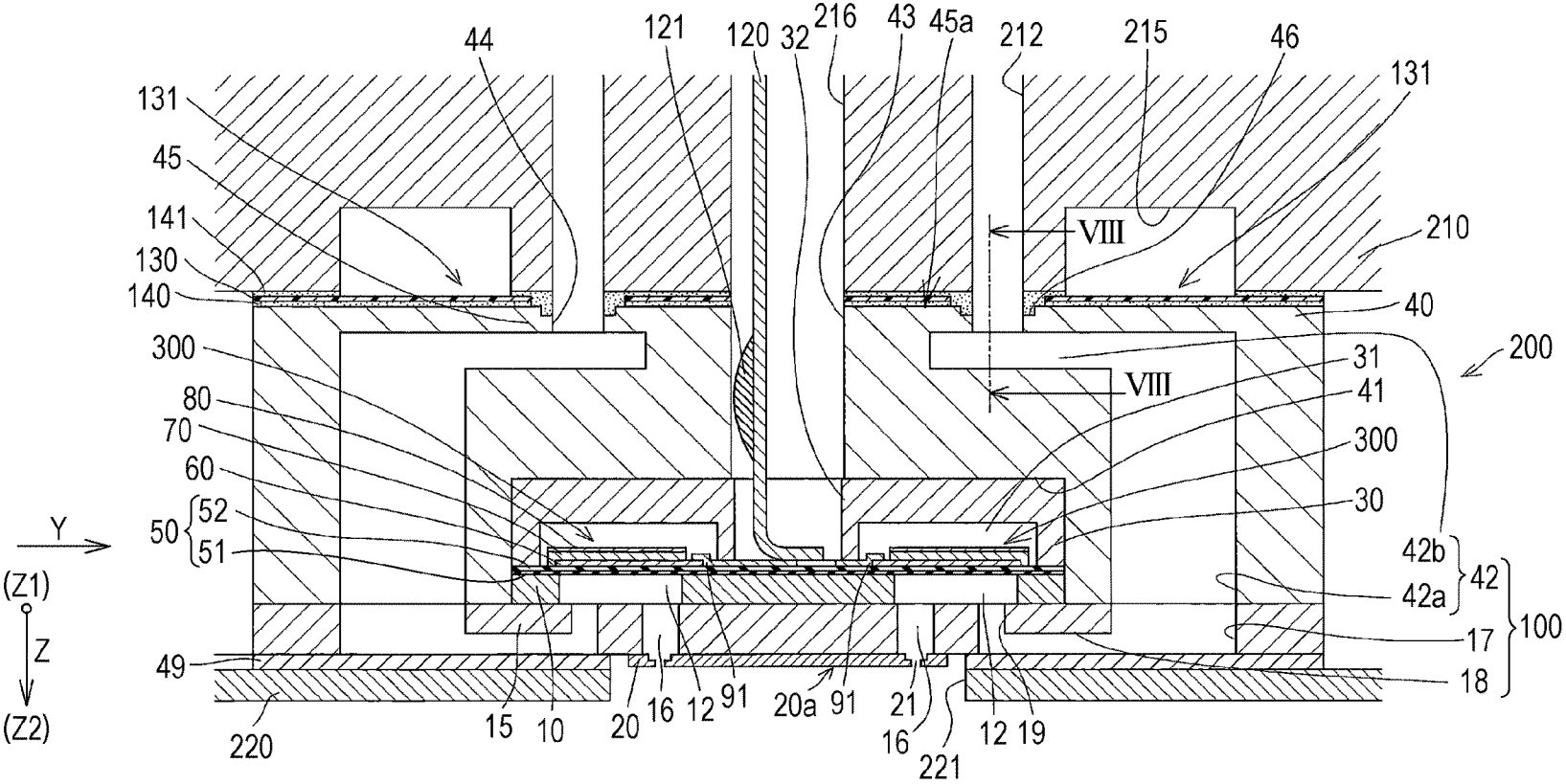
FIG. 6 is a sectional view of the recording head according to the first embodiment.
Figure 7:
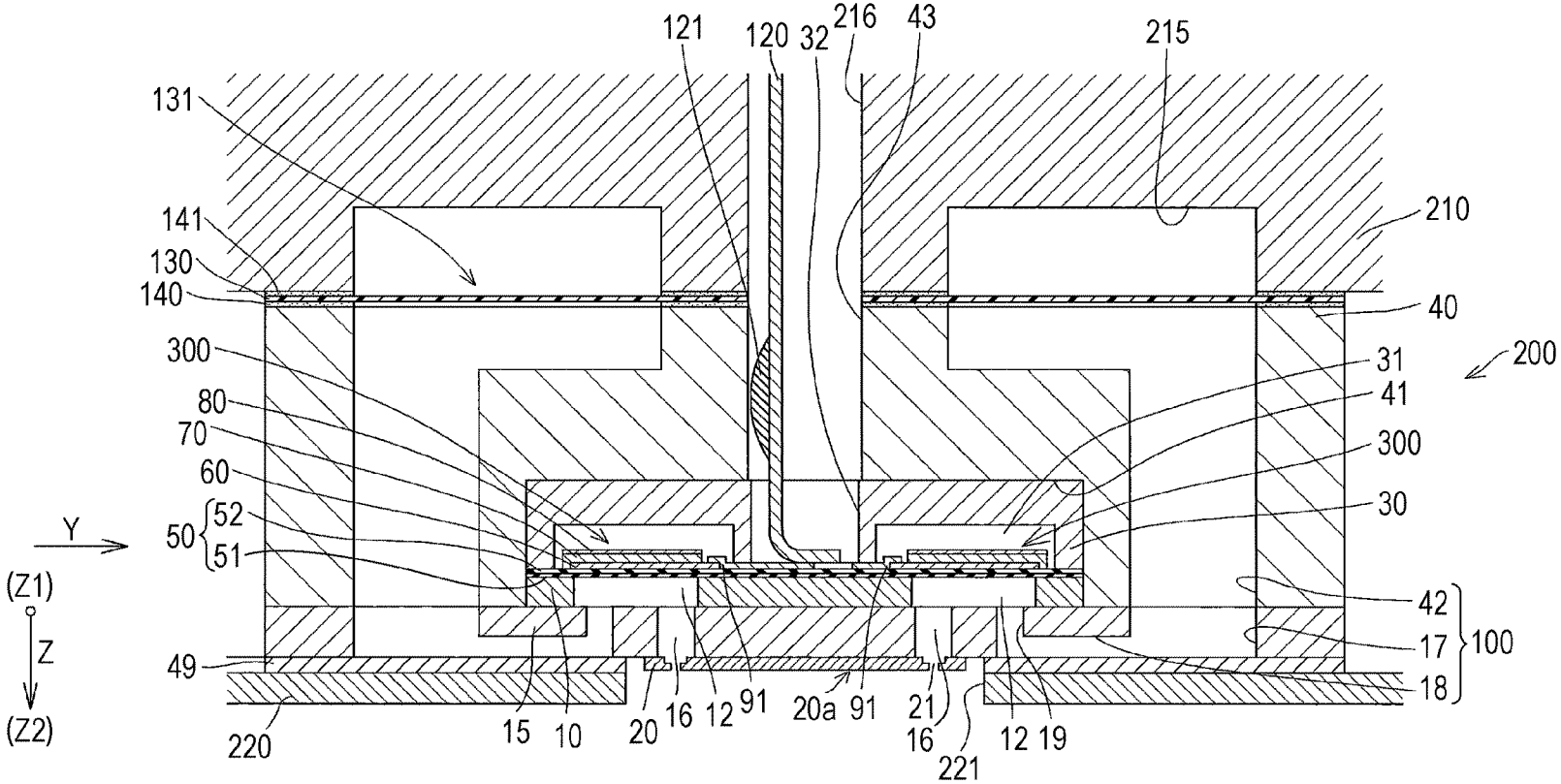
FIG. 7 is a sectional view of the recording head according to the first embodiment.
Figure 8:
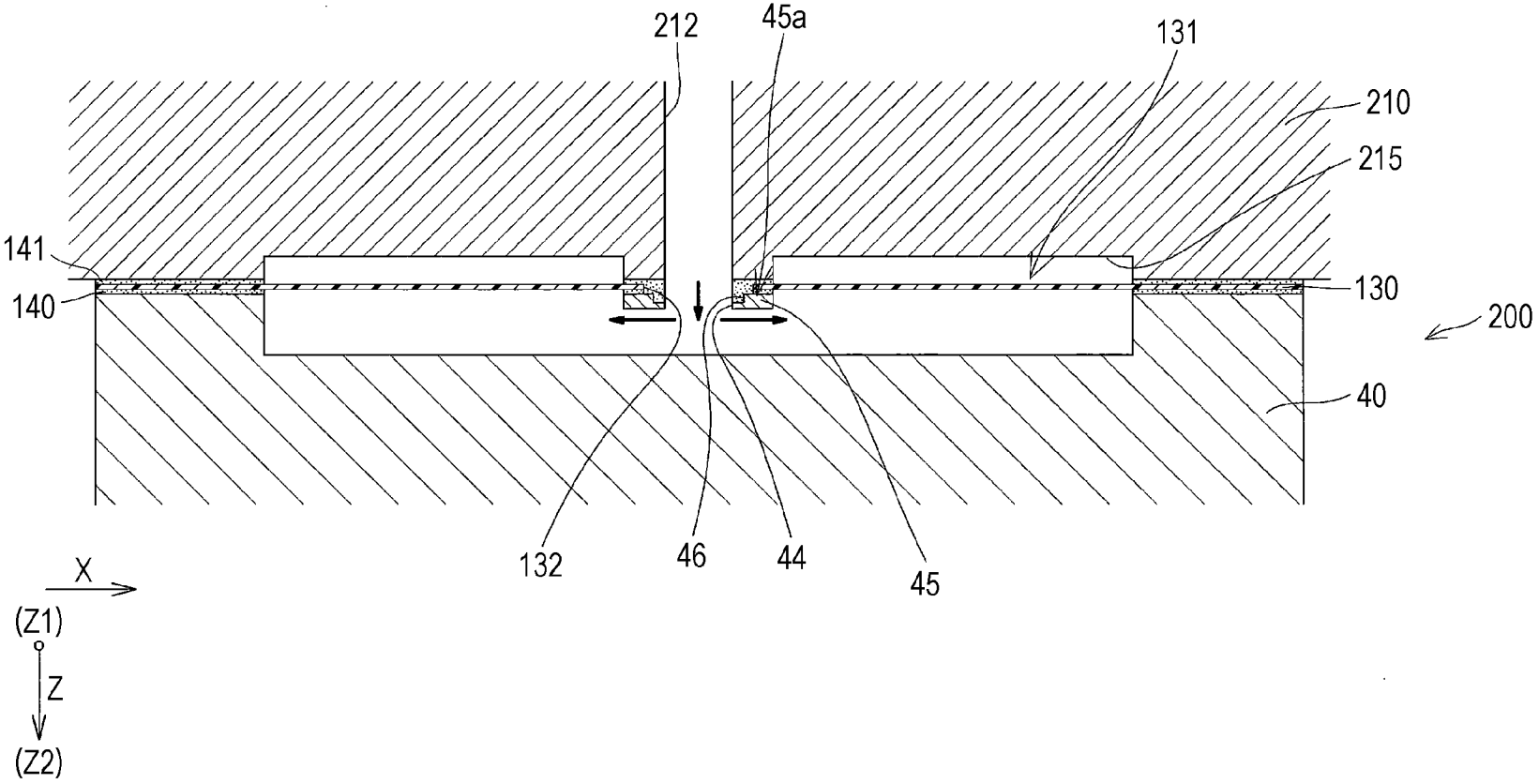
FIG. 8 is a sectional view of the recording head according to the first embodiment.
Figure 9:
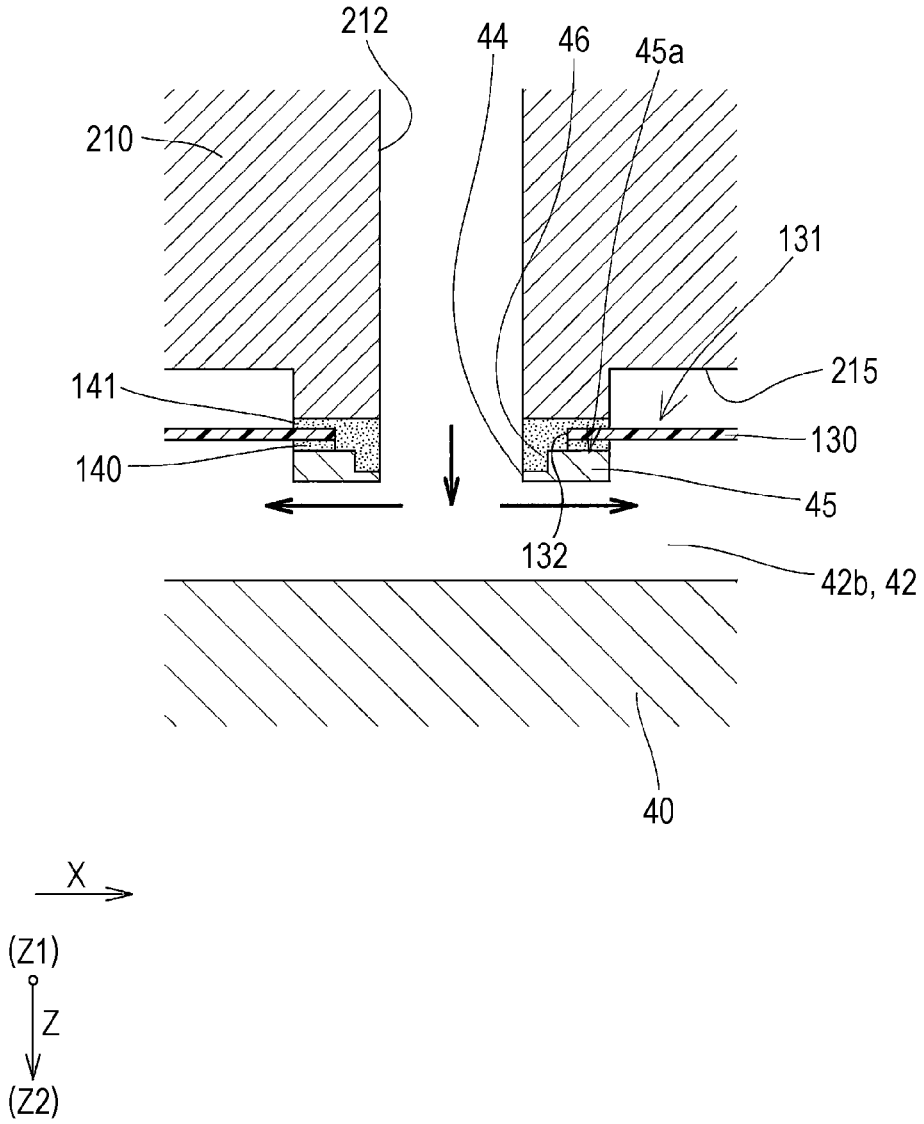
FIG. 9 is an enlarged sectional view of a main part of the recording head according to the first embodiment.

An example of the recording head 200 that is used for the head unit 1 is further described with reference to FIG. 4 to FIG. 9. FIG. 4 is an exploded perspective view of an ink jet recording head that is an example of a liquid ejecting head according to the first embodiment of the invention. FIG. 5 is a main-part plan view of a flow channel forming substrate of the ink jet recording head. FIG. 6 is a sectional view taken along the line VI-VI of FIG. 5. FIG. 7 is a sectional view taken along the line VII-VII of FIG. 5. FIG. 8 is a sectional view taken along the line VIII-VIII of FIG. 6. FIG. 9 is an enlarged view of a main part of FIG. 8. Regarding the respective directions of the recording head 200, this embodiment is described on the basis of the directions defined when the recording head 200 is mounted on the head unit 1, that is, on the basis of the first direction X, the second direction Y, and the third direction Z. As a matter of course, the arrangement of the recording head 200 inside the head unit 1 is not limited to the following arrangement.

As illustrated in FIG. 4 to FIG. 9, in a flow channel forming substrate 10 that constitutes the recording head 200 of this embodiment, pressure chambers 12, which are defined by a plurality of partition walls through anisotropic etching that is performed from one surface side, are juxtaposed along the first direction X. Further, in the flow channel forming substrate 10, a plurality of arrays, in this embodiment two arrays of the pressure chambers 12 juxtaposed in the first direction X, are provided along the second direction Y.

A communication plate 15 and a nozzle plate 20 are sequentially laminated on the Z2 side of the flow channel forming substrate 10 in the third direction Z.

The communication plate 15 is provided with nozzle communication paths 16 that enable the pressure chambers 12 and the nozzles 21 to communicate with each other. The communication plate 15 has a larger area than the flow channel forming substrate 10, and the nozzle plate 20 has a smaller area than the flow channel forming substrate 10. By providing the communication plate 15 as described above, the nozzles 21 of the nozzle plate 20 and the pressure chambers 12 can be spaced away from each other, and hence the ink in the pressure chamber 12 is not easily affected by thickening that may be caused in the ink near the nozzle 21 due to evaporation of water in the ink. Further, the nozzle plate 20 only needs to cover the openings of the nozzle communication paths 16 that enable the pressure chambers 12 and the nozzles 21 to communicate with each other, and hence the area of the nozzle plate 20 can be reduced relatively, thereby being capable of reducing the cost. In this embodiment, the surface of the nozzle plate 20 where the nozzles 21 are open and ink droplets are ejected is referred to as the liquid ejecting surface 20*a*.

Further, the communication plate 15 is provided with first manifold portions 17 and second manifold portions 18 that constitute a part of manifolds 100, which are common liquid chambers communicating with the plurality of pressure chambers 12 in common.

The first manifold portion 17 is provided so as to penetrate the communication plate 15 in the third direction Z. The second manifold portion 18 is provided so as to be open on the nozzle plate 20 side of the communication plate 15 without penetrating the communication plate 15 in the third direction Z.

Further, in the communication plate 15, supply communication paths 19 communicating with the ends of the pressure chambers 12 on one side in the second direction Y are provided independently for the respective pressure chambers 12. The supply communication paths 19 enable the second manifold portion 18 and the pressure chambers 12 to communicate with each other. That is, the supply communication paths 19 are juxtaposed in the first direction X relative to the manifold 100.

The nozzles 21 communicating with the pressure chambers 12 via the nozzle communication paths 16 are formed in the nozzle plate 20. Specifically, the nozzles 21 that eject the same kind of liquid (ink) are juxtaposed in the first direction X, and two arrays of the nozzles 21 juxtaposed in the first direction X are formed along the second direction Y.

Further, a cover 49 is joined to the surface of the communication plate 15 on the Z2 side where the first manifold portions 17 and the second manifold portions 18 are open. The openings of the first manifold portions 17 and the second manifold portions 18 are closed by the cover 49. In this embodiment, the cover 49 is provided to the recording head 200 and the cover head 220 is joined to the surface of the cover 49 on the Z2 side, but the configuration is not particularly limited thereto. For example, the openings of the first manifold portions 17 and the second manifold portions 18 may be closed by the cover head 220 without providing the cover 49.

A diaphragm 50 is formed on the Z1 side of the flow channel forming substrate 10 which is opposite the communication plate 15. In this embodiment, an elastic film 51 provided on the flow channel forming substrate 10 side and formed of a silicon oxide and an insulating film 52 provided on the elastic film 51 and formed of a zirconium oxide are provided as the diaphragm 50. The liquid flow channel such as the pressure chamber 12 is formed by performing anisotropic etching of the flow channel forming substrate 10 from one surface side thereof (side where the nozzle plate 20 is joined), and the pressure chamber 12 is defined by the elastic film 51 on the other surface side of the flow channel forming substrate 10.

Further, piezoelectric actuators 300 each including a first electrode 60, a piezoelectric layer 70, and a second electrode 80 are provided on the diaphragm 50 of the flow channel forming substrate 10. In this embodiment, the piezoelectric actuator 300 is an actuator (pressure generating unit) to be driven by a drive circuit 121 that is a semiconductor element described later in detail. In this embodiment, the first electrodes 60 are divided for the respective pressure chambers 12, and constitute individual electrodes that are provided independently for respective active portions described later in detail. The first electrode 60 is formed narrower in the first direction X than the pressure chamber 12. That is, in the first direction X of the pressure chamber 12, the ends of the first electrode 60 are located on the inner side of a region facing the pressure chamber 12. Further, in the second direction Y, both ends of the first electrode 60 extend toward the outer side of the pressure chamber 12.

The piezoelectric layer 70 is provided continuously in the first direction X so as to have a predetermined width in the second direction Y. The width of the piezoelectric layer 70 in the second direction Y is larger than the length of the pressure chamber 12 in the second direction Y. Therefore, in the second direction Y of the pressure chamber 12, the piezoelectric layer 70 is provided so as to extend toward the outer side of the pressure chamber 12.

In the second direction Y of the pressure chamber 12, the end of the piezoelectric layer 70 on the supply communication path 19 side is located on the outer side of the end of the first electrode 60. That is, the end of the first electrode 60 is covered with the piezoelectric layer 70. Further, the end of the piezoelectric layer 70 on the nozzle 21 side is located on the inner side of the end of the first electrode 60 (pressure chamber 12 side), and hence the end of the first electrode 60 on the nozzle 21 side is not covered with the piezoelectric layer 70.

The piezoelectric layer 70 is formed of a piezoelectric material composed of an oxide formed on the first electrode 60 with a polarization structure. For example, the piezoelectric layer 70 may be formed of a perovskite oxide represented by a general formula of $ABO_3$. A lead-based piezoelectric material that contains lead or a lead-free piezoelectric material that does not contain lead may be used.

In the piezoelectric layer 70, grooves 71 having a recessed shape conforming to the respective partition walls are formed as illustrated in FIG. 5. The width of the groove 71 in the first direction X is substantially equal to or larger than the width of each partition wall in the first direction X. Thus, the rigidity of a part of the diaphragm 50 which faces the end of the pressure chamber 12 in the second direction Y (so-called arm of the diaphragm 50) is reduced, and hence the piezoelectric actuator 300 can be displaced satisfactorily.

The second electrode 80 is provided opposite the first electrode 60 across the piezoelectric layer 70, and constitutes a common electrode that is common to the plurality of active portions. Further, the second electrode 80 may be provided on the inner side of the inner surfaces of the grooves 71, that is, the side surfaces of the grooves 71 of the piezoelectric layer 70, but need not be provided in this manner.

The piezoelectric actuator 300 constituted by the first electrode 60, the piezoelectric layer 70, and the second electrode 80 is displaced by applying a voltage between the first electrode 60 and the second electrode 80. That is, voltage application between the first electrode 60 and the second electrode 80 causes a piezoelectric strain in the piezoelectric layer 70 interposed between the first electrode 60 and the second electrode 80. The portion where the piezoelectric strain is caused in the piezoelectric layer 70 when a voltage is applied between the first electrode 60 and the second electrode 80 is referred to as the active portion. In contrast, the portion where the piezoelectric strain is not caused in the piezoelectric layer 70 is referred to as a non-active portion. In the active portion where the piezoelectric strain is caused in the piezoelectric layer 70, the portion facing the pressure chamber 12 is referred to as a flexible portion, and the portion located outside the pressure chamber 12 is referred to as a non-flexible portion.

Further, as illustrated in FIG. 5, individual wires 91 that are lead wires are led out from the first electrodes 60 of the piezoelectric actuators 300. The individual wires 91 are led out to a portion between two arrays of the piezoelectric actuators 300. Further, common wires 92 that are lead wires are led out from the second electrodes 80.

A flexible cable 120 is electrically connected to the individual wires 91 and the common wires 92. The flexible cable 120 is a flexible wiring substrate, and in this embodiment, the drive circuit 121 that is the semiconductor element is mounted thereon. Print control signals from the outside are supplied to the drive circuit 121 via the flexible cable 120, and drive signals from the drive circuit 121 are supplied to the piezoelectric actuators 300 via the flexible cable 120, the individual wires 91, and the common wires 92.

A protective substrate 30 having substantially the same size as the flow channel forming substrate 10 is joined to the surface of the flow channel forming substrate 10 on the piezoelectric actuator 300 side. The protective substrate 30 includes holding portions 31 that are spaces for protecting the piezoelectric actuators 300. Two holding portions 31 are formed side by side in the second direction Y between the arrays of the piezoelectric actuators 300 juxtaposed in the first direction X. Further, a through hole 32 that penetrates the protective substrate 30 in the third direction Z is provided in the protective substrate 30 at a position between the two holding portions 31 juxtaposed in the second direction Y. The ends of the individual wires 91 and the common wires 92 led out from the respective electrodes of the piezoelectric actuators 300 extend so as to be exposed to the inside of the through hole 32, and the individual wires 91 and the common wires 92 are electrically connected to the flexible cable 120 inside the through hole 32.

A case member 40 that defines, together with the communication plate 15, the manifolds 100 communicating with the plurality of pressure chambers 12 is fixed onto the protective substrate 30. The case member 40 has substantially the same shape as the communication plate 15 in plan view, and is joined to the protective substrate 30 and also to the communication plate 15. Specifically, the case member 40 has a first recess 41 on the protective substrate 30 side with a depth at which the flow channel forming substrate 10 and the protective substrate 30 are accommodated. The first recess 41 has a larger opening area than the surface of the protective substrate 30 which is joined to the flow channel forming substrate 10. In a state in which the flow channel forming substrate 10 and the like are accommodated in the first recess 41, the open surface of the first recess 41 on the nozzle plate 20 side is closed by the communication plate 15.

Further, third manifold portions 42 communicating with the first manifold portions 17 of the communication plate 15 are formed in the case member 40. The third manifold portion 42 includes a penetrating portion 42*a* that penetrates the case member 40 in the third direction Z, and a wide portion 42*b* provided on the Z1 side that is opposite the communication plate 15 and wider in the second direction Y than the penetrating portion 42*a*. In this embodiment, the wide portion 42*b* is provided so as to project toward the piezoelectric actuator 300 side in the second direction Y. Specifically, in this embodiment, the wide portion 42*b* is arranged at a position where a part of the wide portion 42*b* overlaps with the first recess 41 in the plan view along the third direction Z. Thus, the opening of the third manifold portion 42 on the Z1 side has a larger area than on the Z2 side. The manifold 100 that is the common liquid chamber of this embodiment is constituted by the first manifold portion 17 and the second manifold portion 18 provided in the communication plate 15 and the third manifold portion 42 provided in the case member 40. The manifold 100 is provided continuously in the first direction X that is the direction in which the pressure chambers 12 are juxtaposed, and the supply communication paths 19 that enable the respective pressure chambers 12 and the manifold 100 to communicate with each other are juxtaposed in the first direction X.

Further, the case member 40 is provided with a connection hole 43, which communicates with the through hole 32 of the protective substrate 30 and through which the flexible cable 120 is inserted. The connection hole 43 is provided between the two third manifold portions 42 in the second direction Y.

The case member 40 may be formed of, for example, a resin, silicon, a glass, a ceramic, a metal, or a metal oxide. Particularly when a resin is used for the case member 40, the case member 40 can be formed at a low cost by molding. When a metal is used for the case member 40, the case member 40 can be formed by cutting work, etching, lamination of pressed components, or the like.

A film-like compliance sheet 130 is bonded, with a first adhesive 140, to the surface of the case member 40 on the Z1 side where the third manifold portions 42 are open, and the openings of the third manifold portions 42 on the Z1 side are closed by the compliance sheet 130. That is, in this embodiment, the case member 40 corresponds to a first member, and the compliance sheet 130 is provided on the upstream side of the manifolds 100 that are the common liquid chambers. Note that the "recess" of the invention only needs to be a space formed inside the first member, and includes a space formed into a groove shape without penetrating the first member and a space formed by penetrating the first member.

The compliance sheet 130 is formed of a flexible resin having a thickness of, for example, 15 μm or less. Examples of the compliance sheet 130 include a para-aromatic polyamide film. Further, the compliance sheet 130 has an area that is equal to or smaller than the area of the surface of the case member 40 on the Z1 side where the compliance sheet 130 is bonded. That is, the compliance sheet 130 is not provided so as to protrude toward the outer side of the case member 40. Further, in this embodiment, a single compliance sheet 130 is provided continuously so as to close the two third manifold portions 42. As a matter of course, compliance sheets 130 may be provided independently for the respective third manifold portions 42. The thickness of the compliance sheet 130 and the method for fixing the compliance sheet 130 are not particularly limited. A compliance sheet 130 that is thicker than 15 μm may be used, and the compliance sheet 130 may be fixed by welding or the like.

By closing the opening of the third manifold portion 42 with the compliance sheet 130 as described above, a part of the walls of the manifold 100 serves as a compliance portion 131 that is a flexible portion defined by the flexible compliance sheet 130. In this embodiment, the wide portion 42*b* is provided so as to increase the opening area of the third manifold portion 42, thereby being capable of increasing the area of the compliance portion 131. Accordingly, the compliance portion 131 can absorb a significant pressure fluctuation of the ink in the manifold 100.

As illustrated in FIG. 6, first inlets 44 communicating with the third manifold portions 42 are provided on the surface of the case member 40 where the compliance sheet 130 is bonded. The first inlet 44 is provided so as to penetrate, in the third direction Z, a canopy portion 45 provided so as to protrude in the second direction Y from one of the walls which is located between the two third manifold portions 42 to the inside of the wide portion 42*b* to assume a canopy-like shape. In this case, the canopy portion 45 is provided continuously in the second direction Y over a range from one of the wall surfaces to the other. That is, the canopy portion 45 is provided continuously in the second direction Y over the opening of the wide portion 42*b* of the third manifold portion 42. The compliance sheet 130 is also bonded, with the first adhesive 140, to the surface of the canopy portion 45 where the first inlet 44 is open. That is, the surface of the canopy portion 45 on the Z1 side serves as a receiving surface 45*a* to which the compliance sheet 130 is joined.

Further, the compliance sheet 130 is provided with second inlets 132 that are inlets penetrating the compliance sheet 130 in the third direction Z. The second inlet 132 is provided at a position where the second inlet 132 communicates with the first inlet 44 of the canopy portion 45, and has a larger opening than the first inlet 44. Thus, the open peripheral edge of the second inlet 132 of the compliance sheet 130 is joined to the canopy portion 45 on the outer side of the open edge of the first inlet 44.

In addition, on the surface of the canopy portion 45 on the compliance sheet 130 side, an adhesive relief groove 46 having a recessed shape is provided at the open edge of the first inlet 44 on the Z1 side in a circumferential direction of the first inlet 44. That is, the adhesive relief groove 46 communicates with the first inlet 44, and has a larger inner diameter than the first inlet 44 and a smaller inner diameter than the second inlet 132.

The second inlet 132 of the compliance sheet 130 and the first inlet 44 of the canopy portion 45 are arranged at positions where the second inlet 132 and the first inlet 44 face the wide portion 42*b*, that is, at positions where the second inlet 132 and the first inlet 44 overlap with the wide portion 42*b* in the third direction Z. Therefore, the ink introduced from the second inlet 132 of the compliance sheet 130 and the first inlet 44 of the canopy portion 45 is received by the wide portion 42*b*. That is, in this embodiment, the wide portion 42*b* serves as a receiving portion. By providing the wide portion 42*b* serving as the receiving portion as described above, the ink introduced from the second inlet 132 and the first inlet 44 flows into the third manifold portion 42 after impinging against the surface of the wide portion 42*b* on the Z1 side. Thus, the pressure change of the ink in the pressure chamber 12 is not easily affected by a pressure fluctuation of the ink introduced from the second inlet 132 and the first inlet 44.

On the Z1 side of the compliance sheet 130 of the recording head 200, the holder 210 that constitutes the head unit 1 is bonded with a second adhesive 141. For example, a material such as a metal, a resin, silicon, a glass, a ceramic, or a metal oxide may be used for the holder 210. It is preferred that a material other than a metal be used for the holder 210. Particularly when a resin is used, the holder 210 can be formed at a low cost. Further, it is preferred that a material having a coefficient of linear expansion equal to that of the case member 40 be used for the holder 210. Specifically, when a material having a coefficient of linear expansion significantly different from that of the case member 40 is used for the holder 210, the holder 210 and the case member 40 may be warped by heating and cooling due to the difference in the coefficient of linear expansion between the holder 210 and the case member 40. When the holder 210 and the case member 40 are warped, the holder 210 and the case member 40 may peel off from each other or the compliance sheet 130 may become creased or peel off. In particular, the thickness of the compliance sheet 130 of this embodiment is as small as 15 μm or less, and hence the compliance sheet 130 may easily be affected by a stress of deformation caused by the difference in the coefficient of linear expansion between the holder 210 and the case member 40. Thus, it is preferred that materials having equal coefficients of linear expansion be used for the holder 210 and the case member 40. It is more preferred that the holder 210 and the case member 40 be formed of the same material. Accordingly, the peeling of the holder 210 and the case member 40 or the creasing and peeling of the compliance sheet 130 can be suppressed.

The holder 210 is provided with second recesses 215 that are open in regions on the compliance sheet 130 which face the third manifold portions 42, that is, regions which face the compliance portions 131. The second recess 215 has a depth at which deformation of the compliance sheet 130 is not hindered, and hence the deformation of the compliance sheet 130 that is caused by the pressure change of the ink in the manifold 100 is allowed by the second recess 215.

In addition, as described above, the holder 210 is provided with the ink communication paths 212 communicating with the second inlets 132 and the first inlets 44. The ink supplied from the ink communication paths 212 is supplied into the manifolds 100 via the first inlets 44.

Further, the holder 210 is provided with an insertion hole 216 through which the flexible cable 120 is inserted. The flexible cable 120 inserted from the insertion hole 216 side of the holder 210 is inserted through the connection hole 43 of the case member 40 and the through hole 32 of the protective substrate 30, and is electrically connected to the piezoelectric actuators 300 on the flow channel forming substrate 10.

The holder 210 is bonded to the surface of the compliance sheet 130 on the Z1 side with the second adhesive 141. Further, the open edge of the second inlet 132 of the compliance sheet 130 is covered in the circumferential direction with the second adhesive 141 that bonds the holder 210 and the compliance sheet 130 to each other. Specifically, the second inlet 132 of the compliance sheet 130 has a larger opening than the first inlet 44, and hence the open edge of the second inlet 132 of the compliance sheet 130 can be covered with the second adhesive 141 by bonding the compliance sheet 130 to the case member 40 with the first adhesive 140 so that the second inlet 132 is located on the outer side of the first inlet 44. Thus, in the flow channel which is a portion connecting the first inlet 44 and the ink communication path 212 to each other, a part of the compliance sheet 130 which is located near the open edge of the second inlet 132 is covered with the second adhesive 141 without being exposed. In addition, the second adhesive 141 that covers the end surface of the second inlet 132 of the compliance sheet 130 is filled in the adhesive relief groove 46, thereby being capable of reducing the occurrence of a case in which an excess of the second adhesive 141 leaks into the flow channel which is the portion connecting the first inlet 44 and the ink communication path 212 to each other. Thus, generation of a foreign substance due to the excess of the leaked second adhesive 141 is suppressed, thereby being capable of suppressing clogging of the nozzle 21 or the like. In this embodiment, the second adhesive 141 is filled in the adhesive relief groove 46, but the configuration is not particularly limited thereto. The adhesive relief groove 46 can also reduce the occurrence of a case in which the first adhesive 140 that bonds the compliance sheet 130 to the case member 40 leaks into the flow channel. That is, it is only necessary that at least one of the first adhesive 140 and the second adhesive 141 be filled in the adhesive relief groove 46.

In the recording head 200 described above, when ink is ejected, the ink is poured into the manifolds 100 from the ink communication paths 212 via the second inlets 132 and the first inlets 44, and the inside of the flow channels which extend from the manifolds 100 to the nozzles 21 is filled with the ink. After that, in response to a signal from the drive circuit 121, a voltage is applied to the respective piezoelectric actuators 300 corresponding to the pressure chambers 12, thereby deflecting the diaphragm 50 together with the piezoelectric actuators 300. Thus, the pressure in the pressure chambers 12 is increased, and ink droplets are ejected from the predetermined nozzles 21. When the ink is filled in the manifolds 100 from the ink communication paths 212 as described above, the compliance portions 131 of the compliance sheet 130 are flexibly deformed to absorb a pressure change of the ink in the manifolds 100. A pressure fluctuation of the ink in the manifolds 100, which is caused when the ink droplets are ejected from the nozzles 21, is also absorbed through the deformation of the compliance portions 131 of the compliance sheet 130. In particular, in this embodiment, the compliance portion 131 can be provided so as to have a large area owing to the wide portion 42*b* that is the ink receiving portion, and hence the pressure fluctuation in the manifold 100 can be absorbed securely by the compliance portion 131. Thus, the ink supply characteristics and the ink ejection characteristics are improved, thereby being capable of achieving stable ejection of ink droplets. Further, in this embodiment, the compliance sheet 130 having a thickness of 15 μm or less is used, thereby achieving a quick response to the pressure change of the ink in the manifold 100. Thus, in the recording head 200 of this embodiment, a decrease in the ink ejection characteristics can be suppressed also when ink droplets are ejected at high frequencies.

Further, in this embodiment, the receiving surface 45*a* to which the compliance sheet 130 is joined is provided on the canopy portion 45, and hence the periphery of the second inlet 132 of the compliance sheet 130 is supported by the canopy portion 45. Thus, when the holder 210 is joined around the second inlet 132, peeling and ink leakage that may be caused by joining failure due to a low rigidity of the case member 40 can be suppressed. That is, as described later in detail, the recording head 200 can be fixed to the holder 210 after the recording head 200 has been manufactured by joining the compliance sheet 130 to the case member 40 side. Thus, the manifolds 100 of the recording head 200, which have relatively wide openings, can be covered with the compliance sheet 130, and hence the entry of a foreign substance into the flow channels can be suppressed.

Further, in this embodiment, as described above, the compliance sheet 130 is bonded, with the first adhesive 140, to the case member 40 that is preferably formed of a material other than a metal, and the holder 210 that is preferably formed of a material other than a metal is bonded, with the second adhesive 141, to the surface of the compliance sheet 130 which is opposite the case member 40. Therefore, a bonding interface between a metal material and the first adhesive 140 or the second adhesive 141 can be eliminated at the bonding interfaces between the case member 40 and the compliance sheet 130 and between the holder 210 and the compliance sheet 130. Thus, a decrease in the bonding strength of the case member 40, the compliance sheet 130, and the holder 210 is suppressed, thereby being capable of suppressing the peeling and the ink leakage or the like that may be caused along with the peeling. That is, the bonding strength between a material other than a metal and an adhesive is generally higher than the bonding strength between a metal material and an adhesive, and hence the bonding strength can be improved by reducing a portion where a metal material and an adhesive are bonded to each other.

Further, materials other than a metal, in particular, materials having equal coefficients of linear expansion are used for the case member 40 and the holder 210, and hence the warpage and peeling of the case member 40 and the holder 210 due to the difference in the coefficient of linear expansion can be suppressed and the creasing and peeling of the compliance sheet 130 can be suppressed as well.

In addition, in this embodiment, the end surface of the second inlet 132 of the compliance sheet 130, that is, the open edge of the second inlet 132 is covered with the second adhesive 141 so as not to be exposed to the inside of the flow channel, and hence the peeling of the compliance sheet 130 can further be suppressed. Specifically, when the end surface of the second inlet 132 is exposed to the inside of the flow channel, ink seeps into the bonding interfaces between the compliance sheet 130 and the first adhesive 140 and between the compliance sheet 130 and the second adhesive 141, and the bonding strength of the compliance sheet 130 is decreased. Therefore, the peeling of the compliance sheet 130 is liable to occur. In this embodiment, the interfaces between the compliance sheet 130 and the first adhesive 140 and between the compliance sheet 130 and the second adhesive 141 are not directly brought into contact with the ink, and hence the decrease in the bonding strength at the bonding interface of the compliance sheet 130 is suppressed, thereby being capable of suppressing the peeling of the compliance sheet 130.

Figure 10:
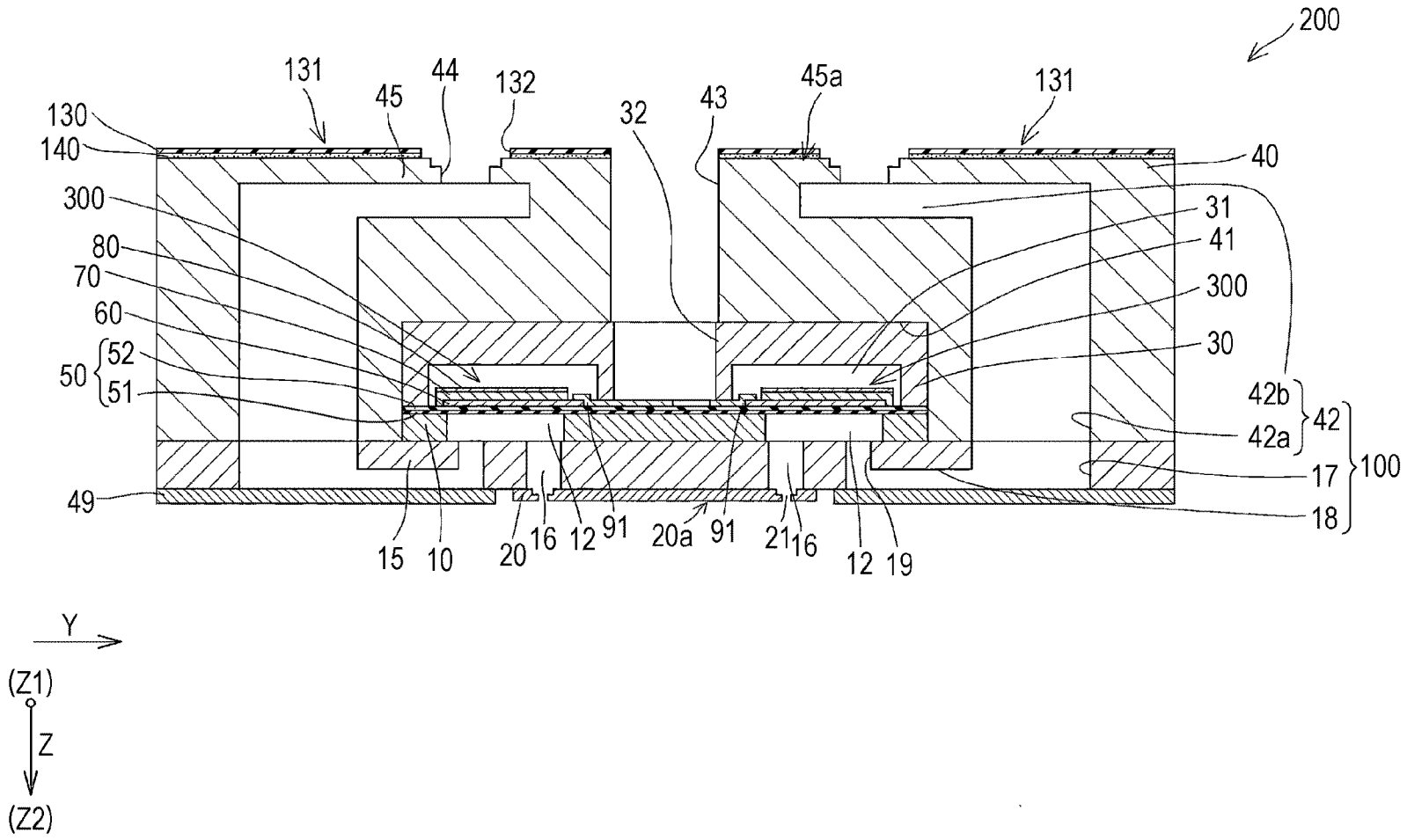
FIG. 10 is a sectional view illustrating a method for manufacturing a head unit according to the first embodiment.
Figure 11:
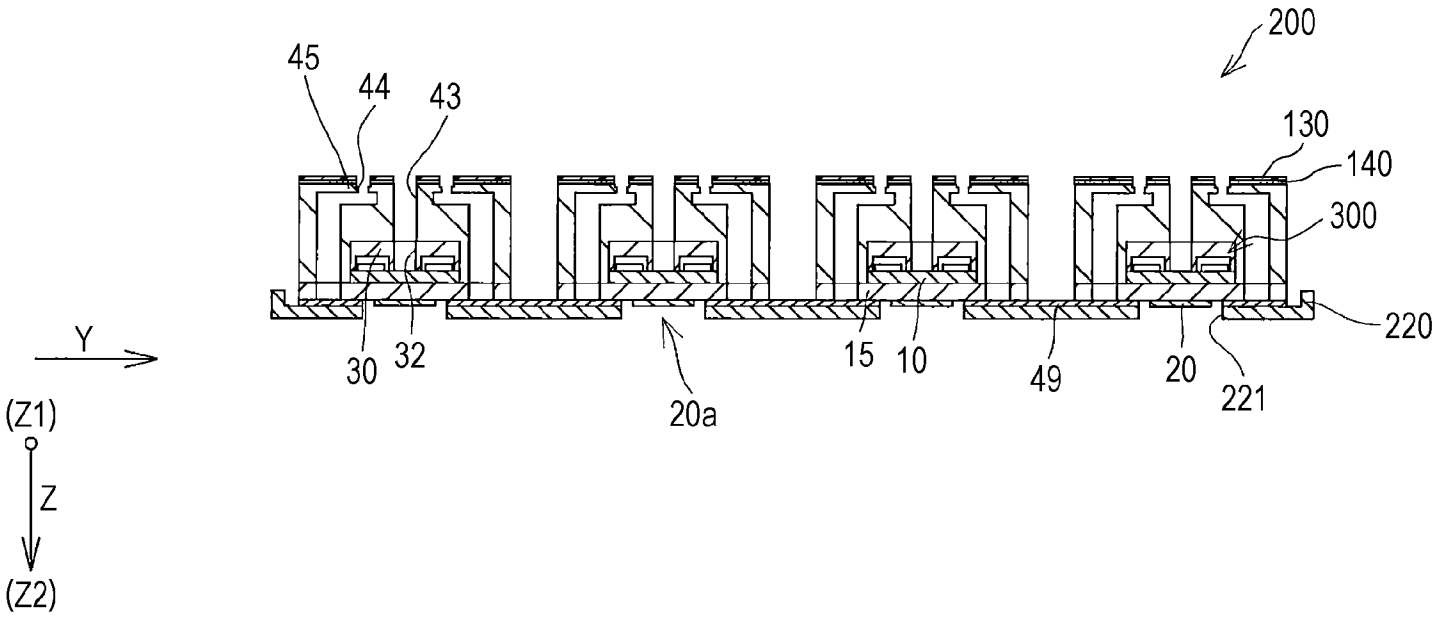
FIG. 11 is a sectional view illustrating the method for manufacturing a head unit according to the first embodiment.
Figure 12:
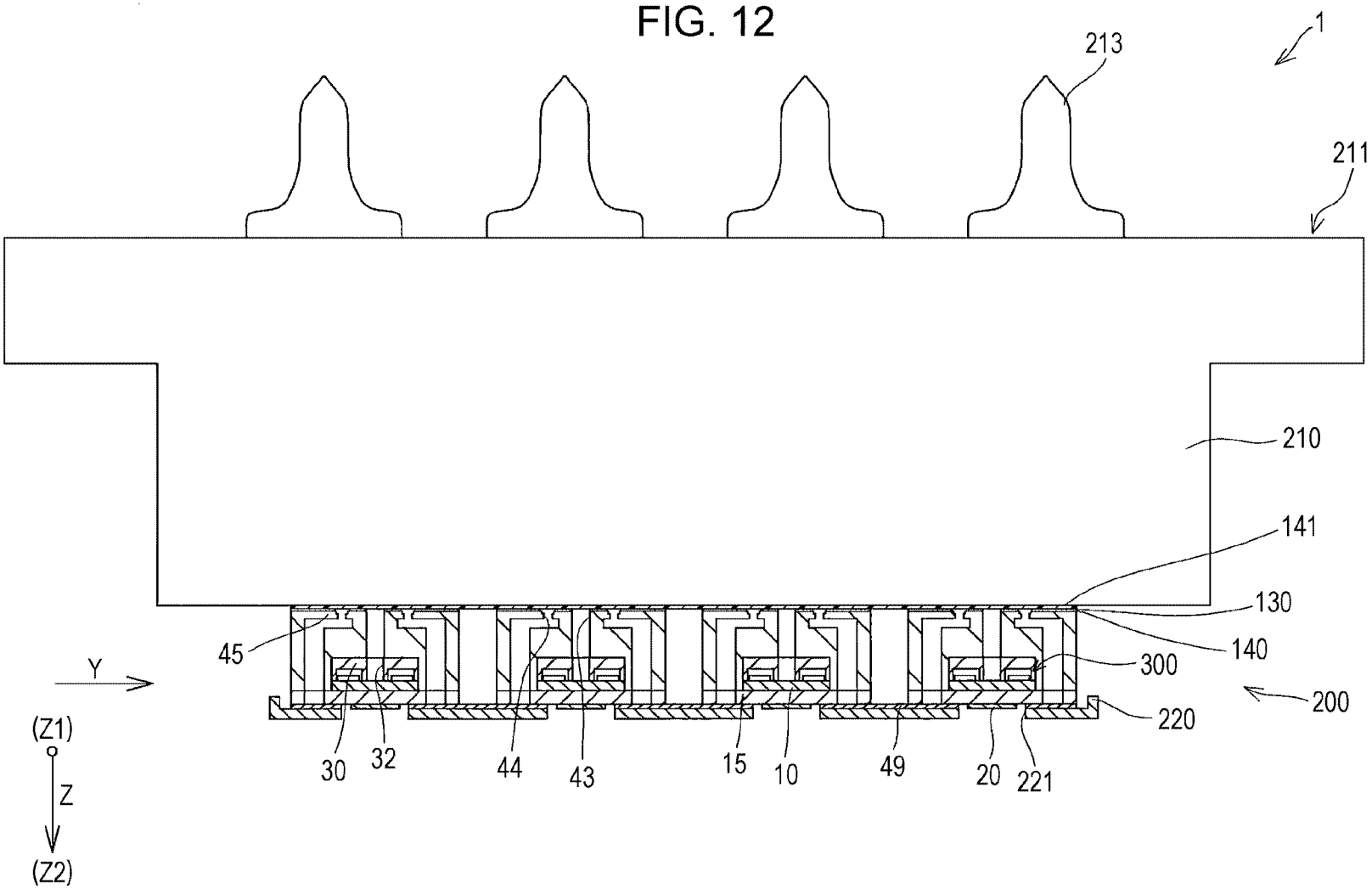
FIG. 12 is a sectional view illustrating the method for manufacturing a head unit according to the first embodiment.

A method for manufacturing the head unit 1 including the recording head described above is described with reference to FIG. 10 to FIG. 12. FIG. 10 to FIG. 12 are main-part sectional views illustrating the method for manufacturing the head unit.

As illustrated in FIG. 10, the compliance sheet 130 is fixed to the case member 40. In this embodiment, the recording head 200 is formed by integrally joining the flow channel forming substrate 10, the protective substrate 30, the communication plate 15, the nozzle plate 20, the cover 49, and the case member 40, and then bonding the compliance sheet 130 to the case member 40 with the first adhesive 140.

When the compliance sheet 130 is bonded to the case member 40 with the first adhesive 140 as described above, the canopy portion 45 is formed on the case member 40, and hence the periphery of the second inlet 132 of the compliance sheet 130 is supported by the canopy portion 45. Accordingly, the rigidity around the second inlet 132 can be secured.

Further, the compliance sheet 130 is bonded to the case member 40 in advance, and hence the openings of the manifolds 100 which are relatively widely open in particular among the portions of the flow channels of the recording head 200 can be sealed with the compliance sheet 130. Thus, the entry of a foreign substance into the flow channels of the recording head 200 can be suppressed. In particular, when a plurality of recording heads 200 are formed and stored, for example, the entry of a foreign substance into the flow channels can be suppressed by the compliance sheet 130.

Next, as illustrated in FIG. 11, the plurality of recording heads 200 are fixed to the cover head 220 while aligning the relative positions of the nozzles 21. By fixing the liquid ejecting surface 20*a* sides of the plurality of recording heads 200 to the common cover head 220 as described above, the heights of the liquid ejecting surfaces 20*a* of the plurality of recording heads 200 in the third direction Z can be set equal to each other, and hence the print quality can be improved.

Next, as illustrated in FIG. 12, the compliance sheet 130 sides of the plurality of recording heads 200 are fixed to the holder 210. In this embodiment, the compliance sheets 130 and the holder 210 are bonded to each other with the second adhesives 141. As a result, the head unit 1 is formed.

At this time, the periphery of the second inlet 132 of the compliance sheet 130 is joined to the receiving surface 45*a* of the canopy portion 45 and is supported by the canopy portion 45. Thus, when the holder 210 is joined to the compliance sheet 130, the periphery of the second inlet 132 of the compliance sheet 130 and the holder 210 can securely be joined to each other. That is, the rigidity around the second inlet 132 is not decreased, thereby being capable of suppressing the peeling, ink leakage, and the like that may be caused by the joining failure between the compliance sheet 130 and the holder 210. That is, by providing the canopy portion 45 as in this embodiment, the compliance sheet 130 can be bonded to the case member 40 in advance.

Further, by fixing the common holder 210 to the plurality of recording heads 200 after the plurality of recording heads 200 have been fixed to the cover head 220, the heights of the liquid ejecting surfaces 20*a* of the plurality of recording heads 200 in the third direction Z can be set equal to each other. The heights of the plurality of recording heads 200 in the third direction Z vary due to a dimensional variation of the members that constitute the recording heads 200, a thickness variation of the adhesives used for laminating the members, and the like. Therefore, when the holder 210 and the plurality of recording heads 200 are joined to each other in advance, the positions of the liquid ejecting surfaces 20*a* of the plurality of recording heads 200 vary, resulting in misalignment of the landing positions of ink droplets. In this embodiment, the liquid ejecting surface 20*a* sides of the recording heads 200 are fixed to the common cover head 220, and hence the dimensional variation of the recording heads 200 in the third direction Z can be suppressed. Further, the dimensional variation of the recording heads 200 in the third direction Z is absorbed by adjusting the thicknesses of the second adhesives 141 that bond the recording heads 200 and the holder 210 to each other, and hence the variation of the heights of the liquid ejecting surfaces 20*a* can be suppressed.

When the canopy portion 45 is not provided, the rigidity around the second inlet 132 of the compliance sheet 130 cannot be secured, and hence the compliance sheet 130 and the holder 210 need to be joined to each other in advance. When the compliance sheet 130 is joined to the holder 210, the manifolds 100 of the recording head 200 are left open, thereby increasing the risk of entry of a foreign substance. Further, in order to absorb the dimensional variation of the recording heads 200 in the third direction Z so that the heights of the liquid ejecting surfaces 20*a* of the plurality of recording heads 200 in the third direction Z may be set equal to each other, it is necessary to adjust the thicknesses of the first adhesives 140 that bond the compliance sheets 130 and the case member 40 to each other. When the thicknesses of the first adhesives 140 are changed among the recording heads 200, however, the volumes of the manifolds 100 vary and therefore the ink ejection characteristics vary as well, thereby causing a risk of a decrease in the print quality. Further, when an attempt is made to form a thick first adhesive 140, there is a risk of trouble such as an increase in the amount of leakage of the first adhesive 140 into the flow channel and a decrease in the flexibility due to sticking of the first adhesive 140 to the compliance portion 131. In this embodiment, the heights of the liquid ejecting surfaces 20*a* are set equal to each other by adjusting the thicknesses of the second adhesives 141 that bond the holder 210 and the recording heads 200 to each other. Thus, the variation of the volumes of the manifolds 100 is suppressed, and hence the variation of the ink ejection characteristics can be suppressed. In addition, the leakage of the first adhesive 140 into the flow channel and the decrease in the flexibility due to sticking of the first adhesive 140 to the compliance portion 131 can be suppressed.

Other Embodiments

One embodiment of the invention has been described above, but the basic configuration of the invention is not limited to the embodiment described above.

In the first embodiment described above, the wide portion 42*b* is arranged at the position where a part of the wide portion 42*b* overlaps with the first recess 41 in the plan view along the third direction Z, but the configuration is not particularly limited thereto. The wide portion 42*b* may be arranged at a position where the wide portion 42*b* does not overlap with the first recess 41 in the third direction Z. Note that, when the wide portion 42*b* is arranged at the position where a part of the wide portion 42*b* overlaps with the first recess 41 in the plan view along the third direction Z as in the first embodiment described above, downsizing can be achieved while securing the area of the compliance portion 131.

Further, in the first embodiment described above, the adhesive relief groove 46 is provided in the case member 40, but the configuration is not particularly limited thereto. The adhesive relief groove 46 may be omitted. Even when the adhesive relief groove 46 is omitted, the second inlet 132 of the compliance sheet 130 is formed as a larger opening than the first inlet 44 and the end surface that is the open edge of the second inlet 132 of the compliance sheet 130 is covered with at least one of the first adhesive 140 and the second adhesive 141, thereby being capable of preventing the end surface of the second inlet 132 from being exposed to the inside of the flow channel. As a matter of course, the end surface of the second inlet 132 may be exposed to the inside of the flow channel. That is, the end surface of the second inlet 132 need not be covered with at least one of the first adhesive 140 and the second adhesive 141. As a matter of course, the first inlet 44 and the second inlet 132 may be formed so as to have substantially equal inner diameters.

In addition, in the first embodiment described above, the recording head 200 that is a structure including the compliance sheet 130 having a thickness of 15 μm or less is exemplified, but the recording head 200 may include a compliance sheet 130 having a thickness of more than 15 μm. Moreover, the method for joining the compliance sheet 130 is not limited to the bonding with the first adhesive 140, but may be welding or the like.

Further, in the first embodiment described above, the opening of the manifold 100 on the Z2 side is closed by the cover 49, but the configuration is not particularly limited thereto. In place of the cover 49, a compliance sheet 130 similar to that of the first embodiment described above may be bonded. Thus, the area of the compliance portion 131 can be increased, and a significant pressure fluctuation of the ink in the manifold 100 can further be absorbed.

In addition, in the first embodiment described above, the first electrodes 60 are provided as the individual electrodes of the respective piezoelectric actuators 300, and the second electrode 80 is provided as the common electrode of the plurality of piezoelectric actuators 300, but the configuration is not particularly limited thereto. The first electrode 60 may be provided as the common electrode of the plurality of piezoelectric actuators 300, and the second electrodes 80 may be provided as the individual electrodes of the respective piezoelectric actuators 300.

Moreover, in the embodiments described above, the description has been given using the thin-film piezoelectric actuator 300 as the pressure generating unit that causes a pressure change in the pressure chamber 12, but the configuration is not particularly limited thereto. For example, there may be used a thick-film piezoelectric actuator formed by a method involving bonding a green sheet, and a longitudinal-vibration piezoelectric actuator in which piezoelectric materials and electrode forming materials are laminated alternately and are expanded/contracted in an axial direction. Further, there may be used a device that includes a heating element arranged inside a pressure chamber as a drive element and ejects a liquid droplet from a nozzle with a bubble generated through heat generation of the heating element, and a so-called electrostatic actuator that ejects a liquid droplet from a nozzle by generating static electricity between a diaphragm and an electrode and deforming the diaphragm with a force of the static electricity.

Figure 13:
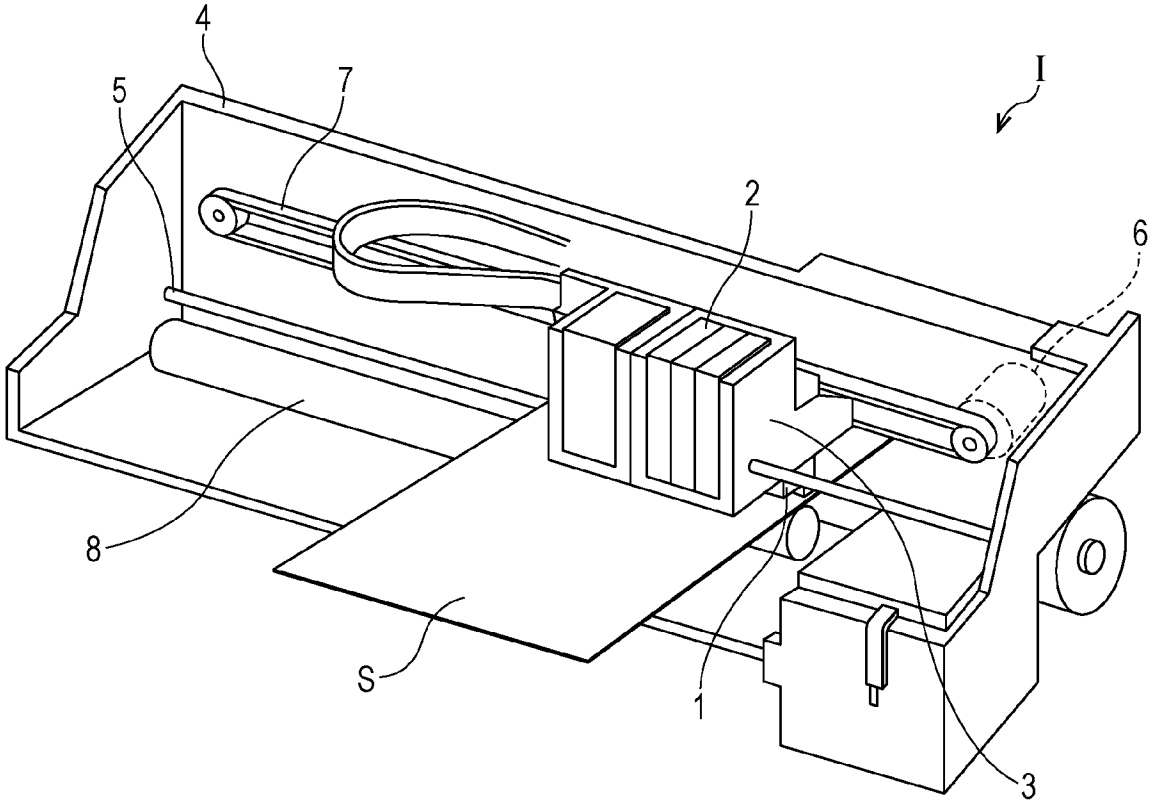
FIG. 13 is a schematic view of a recording apparatus according to one embodiment.

The recording heads 200 described above are mounted on an ink jet recording apparatus I. FIG. 13 is a schematic view illustrating an example of the ink jet recording apparatus of this embodiment.

In the ink jet recording apparatus I illustrated in FIG. 13, cartridges 2 that constitute liquid supplying units are removably provided on the recording heads 200, and a carriage 3 on which the recording heads 200 are mounted is provided on a carriage shaft 5, which is attached to an apparatus body 4, so as to be freely movable in an axial direction.

A drive force of a drive motor 6 is transmitted to the carriage 3 via a plurality of gears (not shown) and a timing belt 7, and hence the carriage 3 on which the recording heads 200 are mounted is moved along the carriage shaft 5. A transport roller 8 serving as a transport unit is provided on the apparatus body 4, and a recording sheet S that is a recording medium such as paper is transported by the transport roller 8. The transport unit that transports the recording sheet S is not limited to the transport roller, but may be a belt, a drum, or the like.

In the example described above, the ink jet recording apparatus I is configured such that the cartridges 2 that are ink supplying units are mounted on the carriage 3, but the configuration is not particularly limited thereto. For example, liquid supplying units such as ink tanks may be fixed to the apparatus body 4, and the liquid supplying units and the recording heads 200 may be connected to each other via supply tubes. Further, the liquid supplying units need not be mounted on the ink jet recording apparatus.

In addition, the ink jet recording apparatus I in which the recording heads 200 are mounted on the carriage 3 and are moved in a main scanning direction is exemplified above, but the configuration is not particularly limited thereto. For example, the invention is also applicable to a so-called line type recording apparatus in which the recording heads 200 are fixed and printing is performed only by moving the recording sheet S such as paper in a sub-scanning direction.

Further, the invention is directed widely to general liquid ejecting heads, and is also applicable to, for example, recording heads such as various types of ink jet recording heads to be used for image recording apparatuses such as a printer, color material ejecting heads to be used for manufacturing color filters of liquid crystal displays or the like, electrode material ejecting heads to be used for forming electrodes of organic EL displays, field emission displays (FEDs), or the like, and bioorganic compounds ejecting heads to be used for manufacturing biochips. Further, the description has been given taking the ink jet recording apparatus I as an example of the liquid ejecting apparatus, but the invention is also applicable to liquid ejecting apparatuses that use the other liquid ejecting heads described above.

Further, the invention is directed widely to MEMS devices, and is also applicable to MEMS devices other than the recording head. Examples of the MEMS devices include an ultrasonic device, a motor, a pressure sensor, a pyroelectric element, and a ferroelectric element. The MEMS devices also include completed products that use those MEMS devices, such as an apparatus that ejects liquid or the like by using the recording head, an ultrasonic sensor that uses the ultrasonic device, a robot that uses the motor as a drive source, an IR sensor that uses the pyroelectric element, and a ferroelectric memory that uses the ferroelectric element.

Moreover, the invention is directed widely to structures, and is also applicable to structures to be used for devices other than the MEMS devices.

What is claimed is:

1. A liquid ejecting head, comprising:

a plurality of actuators;

a plurality of pressure chambers that are provided so as to correspond to the actuators, and communicate with a common liquid chamber;

a first member that defines the common liquid chamber, and includes:

a compliance sheet that absorbs vibrations of liquid on an upstream side of the common liquid chamber; and an inlet that is formed so as to penetrate the compliance sheet;

a canopy portion that is provided at an open peripheral edge of the inlet of the first member, and has a receiving surface to which the compliance sheet is joined; and a receiving portion that is provided opposite the inlet across the canopy portion, and receives liquid introduced from the inlet.

2. The liquid ejecting head according to claim 1, wherein the first member and the compliance sheet are bonded to each other with an adhesive.

3. A liquid ejecting head unit, comprising:

a plurality of the liquid ejecting heads according to claim 1; and a holder to which the compliance sheets of the plurality of the liquid ejecting heads are fixed in common.

4. The liquid ejecting head unit according to claim 3, wherein the holder and the first member are non-metallic members.

5. The liquid ejecting head unit according to claim 4, wherein the first member and the holder are formed of the same material.

6. A liquid ejecting head unit, comprising:

a plurality of the liquid ejecting heads according to claim 2; and a holder to which the compliance sheets of the plurality of the liquid ejecting heads are fixed in common.

7. The liquid ejecting head unit according to claim 6, wherein the holder and the first member are non-metallic members.

8. The liquid ejecting head unit according to claim 7, wherein the first member and the holder are formed of the same material.

9. A liquid ejecting apparatus, comprising the liquid ejecting head unit according to claim 3.

10. A liquid ejecting apparatus, comprising the liquid ejecting head unit according to claim 4.

11. A liquid ejecting apparatus, comprising the liquid ejecting head unit according to claim 5.

12. A liquid ejecting apparatus, comprising the liquid ejecting head unit according to claim 6.

13. A liquid ejecting apparatus, comprising the liquid ejecting head unit according to claim 7.

14. A liquid ejecting apparatus, comprising the liquid ejecting head unit according to claim 8.

15. A method for manufacturing a liquid ejecting head unit including a plurality of liquid ejecting heads and a holder to which the plurality of liquid ejecting heads are joined in common, each of the liquid ejecting heads including:

a plurality of actuators;

a plurality of pressure chambers that are provided so as to correspond to the actuators;

a common liquid chamber that communicates with the plurality of pressure chambers in common;

a first member that defines the common liquid chamber, and includes a compliance sheet that absorbs vibrations of liquid on an upstream side of the common liquid chamber, and an inlet that is formed so as to penetrate the compliance sheet;

a canopy portion that is provided at an open peripheral edge of the inlet of the first member, and has a receiving surface to which the compliance sheet is joined; and a receiving portion that is provided opposite the inlet across the canopy portion, and receives liquid introduced from the inlet, the method comprising:

forming the liquid ejecting heads by joining the compliance sheets at least to the receiving surfaces of the canopy portions, respectively; and joining the compliance sheets of the plurality of liquid ejecting heads to the holder with an adhesive.

* * * * *